US006144900A

United States Patent [19]

Ali et al.

[11] Patent Number: 6,144,900

[45] **Date of Patent: *Nov. 7, 2000**

[54] AUTOMATIC SERIALIZATION OF AN ARRAY OF WIRELESS NODES BASED ON COUPLED OSCILLATOR MODEL

[75] Inventors: Irfan Ali, Schenectady, N.Y.; Michael Paul Weir, Mainville, Ohio; Kenneth Brakeley Welles, II, Scotia, N.Y.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/062,018

[22] Filed: Apr. 17, 1998

[51] Int. Cl.[7] ..... G05D 1/00; G06F 7/00

[52] U.S. Cl. ..... 701/19; 246/6; 246/122 R; 246/167 R

[58] Field of Search ..... 701/19, 20; 340/933, 340/825.06, 531, 825.02, 438, 536, 538; 246/1 C, 122 R, 167 R, 6, 2 E, 2 R, 4, 169 R, 187 R; 370/346, 321; 713/323, 324

[56] References Cited

U.S. PATENT DOCUMENTS

| | | | |
|---|---|---|---|
| 4,041,470 | 8/1977 | Slane et al. | 701/35 |
| 4,774,669 | 9/1988 | Schmitz et al. | 701/117 |
| 5,265,832 | 11/1993 | Wesling et al. | 244/169 R |
| 5,289,176 | 2/1994 | Novakovich et al. | 340/825.08 |
| 5,293,632 | 3/1994 | Novakovich et al. | 701/19 |
| 5,317,751 | 5/1994 | Novakovich et al. | 701/19 |
| 5,353,413 | 10/1994 | Novakovich et al. | 701/19 |
| 5,588,005 | 12/1996 | Ali et al. | 370/346 |
| 5,651,517 | 7/1997 | Stevens et al. | 246/2 R |
| 5,777,547 | 7/1998 | Waldrop | 340/438 |
| 5,966,084 | 10/1999 | Lumbis et al. | 340/933 |

OTHER PUBLICATIONS

"Basic Adaptive Network Discipline for Information Transfer", Microlink Systems Limited, Upper Kindlestown Hill, Delgany, Co., Wicklow, Republic of Ireland. No date.

Gus Welty, "Electro–Pneumatic Braking: How is now the question", Railway Age, May 1997, pp. 43, 46, 48.

*Primary Examiner*—Jacques H. Louis-Jacques
*Attorney, Agent, or Firm*—Marvin Snyder; Douglas E. Stoner

[57] ABSTRACT

A linking process allows a head-end unit (HEU) of a railroad train to determine the sequence of cars in the train using wireless links between nodes on the cars, and requires no physical connection between the nodes or cars. Each car in the train is equipped with a wireless communication device which models an oscillator i. Each oscillator is phase-variable, the phase $\theta_i$ linearly increasing from 0 to 1 such that, when the $i^{th}$ oscillator "fires", transmitting a packet, and phase $\theta_i$ then jumps back to zero. When a car receives the transmission of another car, it changes the phase of its oscillator according to a phase-response curve function, setting up a wave pattern of transmission from nodes, from one end of the train to the other end. The wave pattern, along with protocol logic, enables each car to determine the sequence in which cars are arranged in its vicinity. The protocol logic also enables each car to forward or relay this "local map" from all cars to the HEU, allowing the HEU to construct the entire train map which is the sequence of cars in the train. The compiled train map is compared with consist information and the operator is notified of any discrepancy.

17 Claims, 16 Drawing Sheets

AUTOMATIC SERIALIZATION OF AN ARRAY OF WIRELESS NODES BASED ON COUPLED OSCILLATOR MODEL

BACKGROUND OF THE INVENTION

1. Field of the Invention

This invention generally relates to determining sequential location of limited range wireless communication devices arranged in an array so as to enable end-to-end communication for the array. Primary application is to electro-pneumatic braking systems for railroad trains wherein the invention relates, more particularly, to a linking process for determining the sequence in which the cars are attached to the train.

2. Description of the Prior Art

A linear array of short-range wireless nodes enables communications over a range far greater than the communication range of an individual node. A particular example of such a system is the wireless electro-pneumatic braking (EPBrake) system being introduced to the railroads by GE-Harris, Melbourne, Fla. This EPBrake system utilizes radio links to convey information up and down the train. Each car in the train has a radio of limited range, about five to ten cars, as compared to the length of a train which can be about 250 cars (1½ to 2 miles in length). The key enabling technology for the deployment of the wireless network is the ability of the nodes to autonomously determine their sequential location and relay or forward messages to provide end-to-end communication in a timely manner. In particular for the EPBrake system, at the time of assembly of a train, the head-end unit (HEU) in the lead locomotive needs to ascertain the identities of the cars connected in the train, through a process termed the Linking Process. During the linking process the HEU also needs to ascertain the sequence in which the cars are connected to the train. This is referred to as "serialization".

SUMMARY OF THE INVENTION

A linear array of short-range wireless communication devices which are only able to communicate with a subset of their neighbors is autonomously configured so as to enable determination, at a node at one end of the array, of the identities of all the nodes in the network and also the serial arrangement of the nodes. As part of an electro-pneumatic braking system for a train, a linking process is provided which allows a head-end unit (HEU) in the lead locomotive of the train to ascertain the sequence of cars in the train.

In a linear array of N wireless nodes, each node can communicate with its K-nearest-neighbors ($K \geqq I$) and has a unique identification (ID) by which it can be addressed. The network of nodes, in a preferred embodiment, constitutes a train with a clearly designated head-node or HEU in the lead locomotive at one end of the train, the other nodes of the network being specific cars of the train. The last car in the train is the end-of-train (EOT). The invention facilitates:

1. Automatic configuration of the network, though which the HEU is aware of unique addresses of all nodes in the train. In addition the HEU is also aware of the order in which the nodes are placed.
2. A simple protocol for relaying messages from each node to the HEU and the EOT.
3. A simple protocol for relaying messages from the HEU and EOT to each node.
4. A process by which individual nodes adjust their transmission times to reduce probability of message collisions. This provides reliable communication.

5. A protocol by which each node conserves battery power by enabling the radio to be in a powered-down or "sleep mode" and by reducing the duty cycle of the communication receiver portion of the radio.
6. Ability of the network to dynamically reconfigure itself; i.e., if more nodes are added to or removed from the network, or the RF communication range of nodes changes, or the nodes move relative to one another, the network adjusts itself to this change and the HEU can be informed of the reconfiguration.
7. Robustness of communication for the case of K>I. In this instance, one or more nodes can fail without disrupting the network.

DETAILED DESCRIPTION OF A PREFERRED EMBODIMENT OF THE INVENTION

Figure 1:
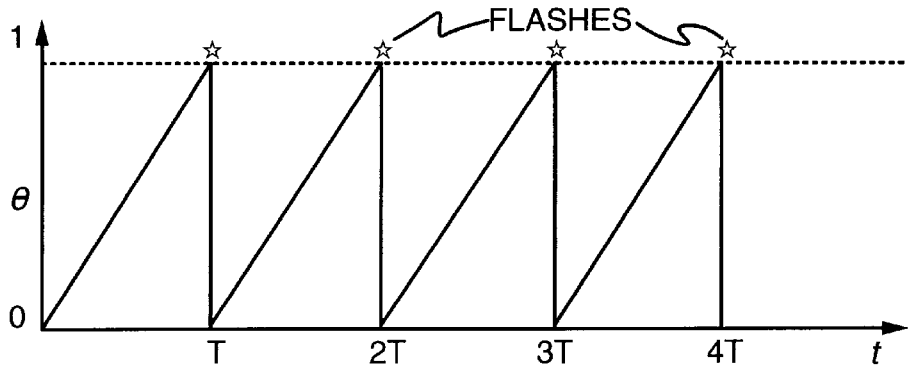
FIG. 1 is a graphical representation of an oscillator output waveform, showing individual oscillator phase variation.

The invention is described in terms of a preferred embodiment in which each node (i.e., at a car) communicates with adjacent nodes using radio links; however, it will be understood by those skilled in the art that "radio links" can include, not only radio frequency (RF) links, but also infrared (IR), magnetic and ultrasound links as well. Therefore, without loss of generality, the terms "radio" and "radio links" are used herein to mean any type of wireless communication.

Although the preferred embodiment of the invention is described for use with a wireless electro-pneumatic brake system, those skilled in the communications arts will recognize that the invention can equally well be employed in other applications using a linear array of wireless nodes. These applications include, but are not limited to, the following:

1. Distributed sensing inside hard to reach areas, such as compact machines. For example, one might be interested in monitoring the temperature at different points inside a turbine or an automobile engine. In most cases, it is not possible to communicate from an outside computer to wireless nodes placed at the points in the engine where temperature needs to be monitored. However, multiple nodes placed inside the engine may be able to communicate locally and forward temperature information to a data logging computer on the outside.
2. Monitoring equipment that is on shelves. A linear arrangement of wireless nodes can be placed at the back end of the shelves. These nodes can have the capability of forwarding messages to the end of the shelf where an end-node, which can be wired to the data logging computer, is located. All the equipment needing to be tracked may also be equipped with wireless units, i.e., tags, which communicate with at least one of the shelf nodes. The communication range requirement of these tags is small, and they fulfill the requirement for compact long-lasting tags on equipment. Shelf-nodes can have more battery power as they are essentially static. Their deployment is also very simple, as no power/wire connection is needed. The equipment should be placed on the shelves in a manner that allows its tags to communicate with the shelf-nodes. The distributed node network can not only provide information about the equipment on the shelves but also the order in which equipment is placed. This can be advantageous in searching for equipment especially placed on long shelves.
3. Monitoring of boxes on pallets. In one logistics application, multiple boxes on pallets need to be monitored. The nodes on the boxes themselves have to be very inexpensive (less than $1.00), which apart from transmitting ID information may also transmit temperature information from the pallets. Each box contains an inexpensive IR/RF communication node. Boxes can be fabricated in a manner that allows them to be placed on top of each other only in one way, thereby ensuring that all tags are on the same side and can communicate with tags above and below. These tags can then forward messages to end-tags located at the base on the pallet. The end-tags on the pallets may in turn be connected to more powerful radios which can communicate with fixed interrogators.
4. Extended geographical area sensing. Nodes can be placed over a wide area with the data logging computer connected to the end-node at one end. Deployment of the nodes is very simple—each node should be within communication range of a node on either side.
5. Battlefield and low probability of intercept (LPI) sensing. In a battlefield scenario, where it is not possible to have a base station within communication range of all nodes due to security reasons, or where distributed sensing from a large area is required, the distributed architecture of nodes can be used. Since the transmission power requirement of the nodes is very low, the network can be used for LPI sensing applications.
6. Dynamic network discovery. In situations where the nodes are on platforms that move with respect to one another, for example animals, or cars on a highway, and node data from each of the nodes are desired, as well as the order in which the nodes are located, the distributed node network will provide this information.

The invention employs coupled oscillators. Each oscillator i is phase-variable, subject to dynamics. The phase of an oscillator increases linearly from 0 to 1 over a period $$T_i = \frac{1}{\omega_i}.$$

When phase $\theta_i=1$, the $i^{th}$ oscillator "flashes" or "fires" (i.e., transmits a packet) and phase $\theta_i$ jumps back to zero. Thus $$\frac{d\theta_i}{dt} = \omega_i \quad 0 \le \theta_i \le 1 \quad i = 1, \ldots, N$$

Figure 2:
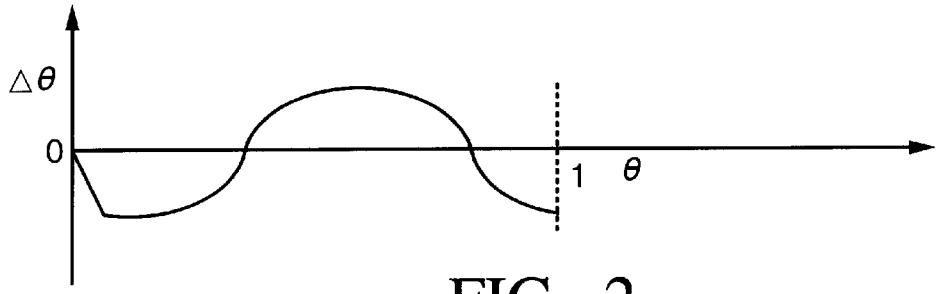
FIG. 2 is a graphical representation of an oscillator output waveform showing the oscillator phase-response curve (PRC)
Figure 3:
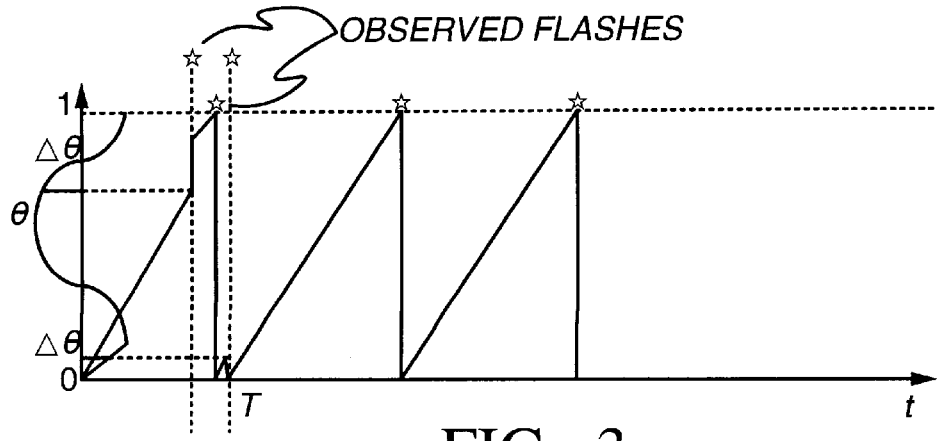
FIG. 3 is a graphical representation of an oscillator output waveform showing oscillator phase variation in the presence of external stimuli.

FIG. 1 illustrates this variation in individual oscillator phase. When oscillator i fires, it changes the phase of another oscillator, say oscillator j, by an amount which depends on the phase of oscillator j, as generally illustrated in FIG. 2. This is called pulse coupling between oscillators and is described as follows:

$$\theta_i(t)=1 \Rightarrow \theta_m(t^+)=\theta_j(t)+K_{ij}f(\theta_j(t))\forall_{j\neq i}$$

where $K_{ij}$ is the coupling between oscillators i and j ($0<K_{ij}<1$), and $f(\theta)$ is the phase-response curve (PRC) of the oscillator. The result of this pulse coupling is illustrated in FIG. 3. The coupling range is described below:

Nearest Neighbor coupling All-to-all coupling $$K_{ij} = \begin{cases} 1 & j = i \pm 1 \\ o & \text{otherwise} \end{cases} \qquad K_{ij} = 1 \quad \forall\, j \neq i$$

Figure 4:
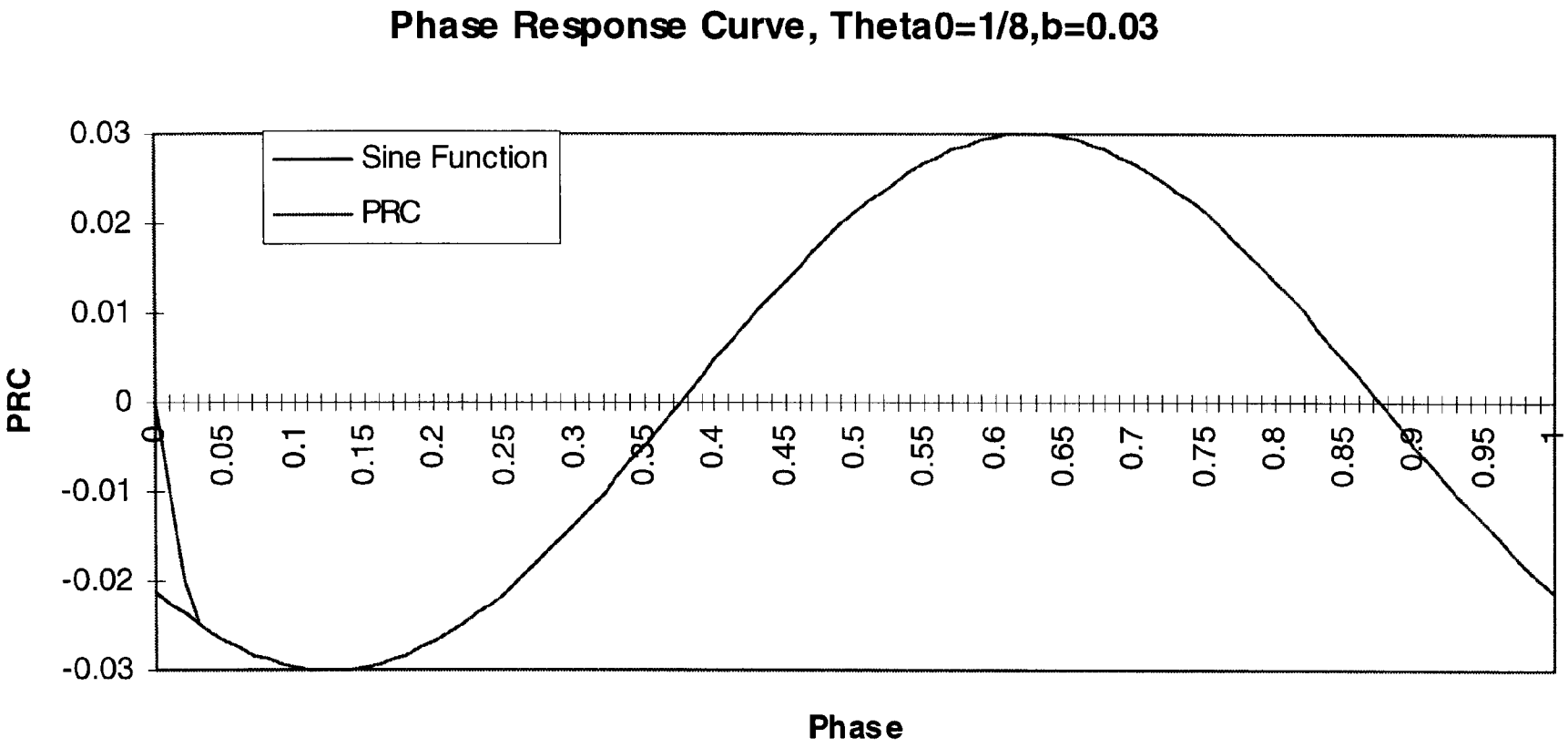
FIG. 4 is a graph of a shifted negative sinusoid phase response curve.

The phase-response curve (PRC) is shown in FIG. 4 and is described by $f(\theta)=\max(-\theta,-b \sin 2\pi(\theta+\theta_0))$, where b=0.03 and $\theta_0=0.125$.

Assumptions for setting up a wave pattern of transmission

Assumption 1

The frequency of all the oscillators is exactly the same.

$$\omega_i = \omega_j^{def} = 1 \quad \forall\, i, j = 1, \ldots, N$$

Assumption 2

The firing of oscillators is an instantaneous event and updating of all coupled oscillators occurs immediately.

Assumption 3

Coupling coefficients are either 0 or 1. The communication is K-nearest neighbor communication. The communication radius is the same for all nodes.

Assumption 4

All oscillators have the same phase response curve, which is shown in FIG. 1.

Additional Rule for Node N

When node N reaches its threshold, it fires (like any other node). In addition, it fires / additional flashes, $1 \leqq l \leqq 3$. These firings are separated in time by Δ units. The value of / and Δ depend on the radius of coupling k and are given by $$l = \min\left(\frac{k}{2}, 3\right)$$

$$\Delta = \begin{cases} 0.125 & k = 1 \\ 0.08 & \text{otherwise} \end{cases}$$

These assumptions have been made to simulate the ideal conditions. The system still functions accurately when the assumptions are relaxed, but for sake of brevity those results are not reported here.

Simulation Results

Figure 7:
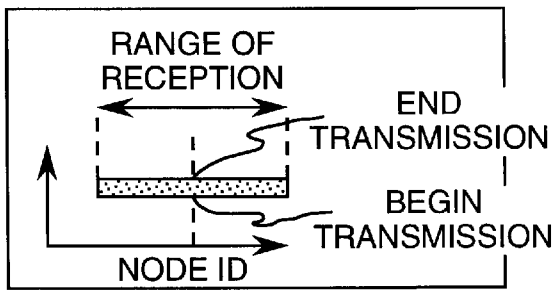
FIG. 7 is a graphic illustration of an exemplary node, identifying its parameters.
Figure 5:
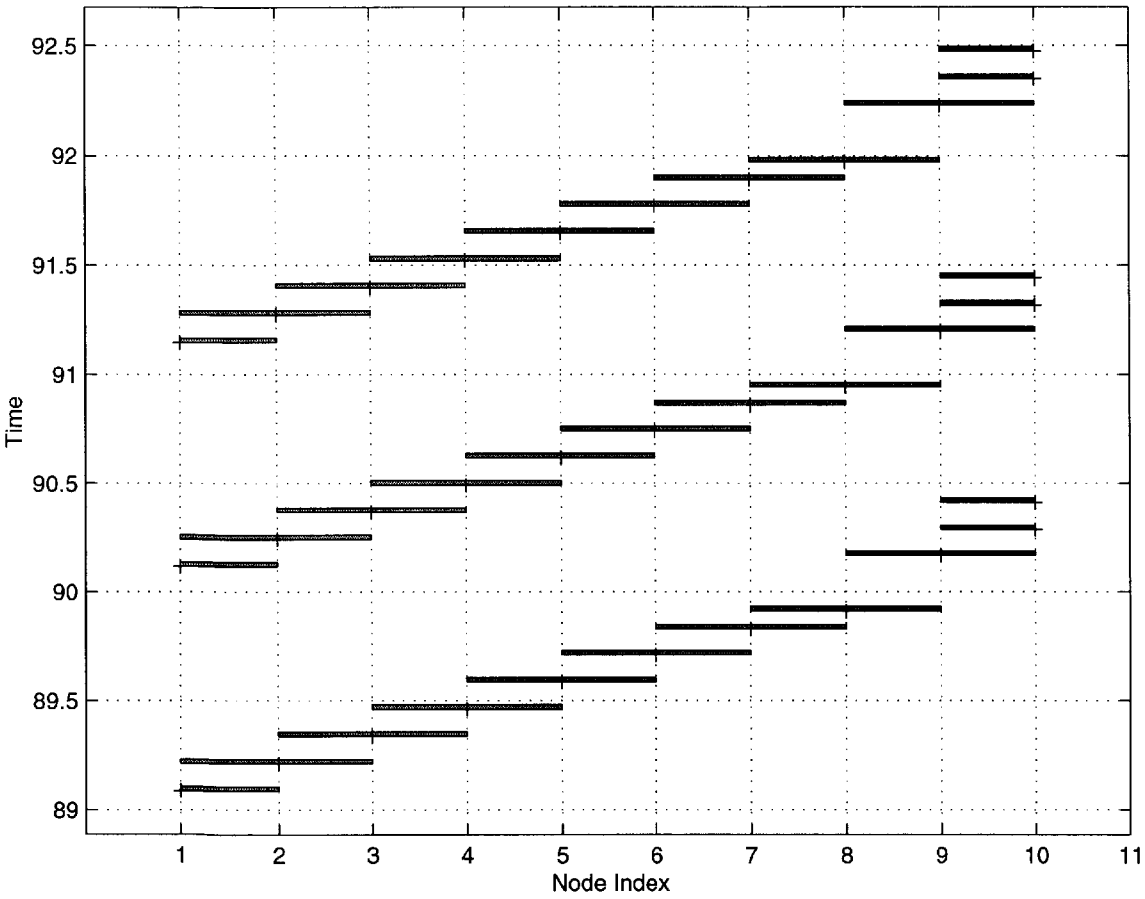
FIG. 5 is a graphic representation of a wave pattern with 1-nearest neighbor coupling.
Figure 6:
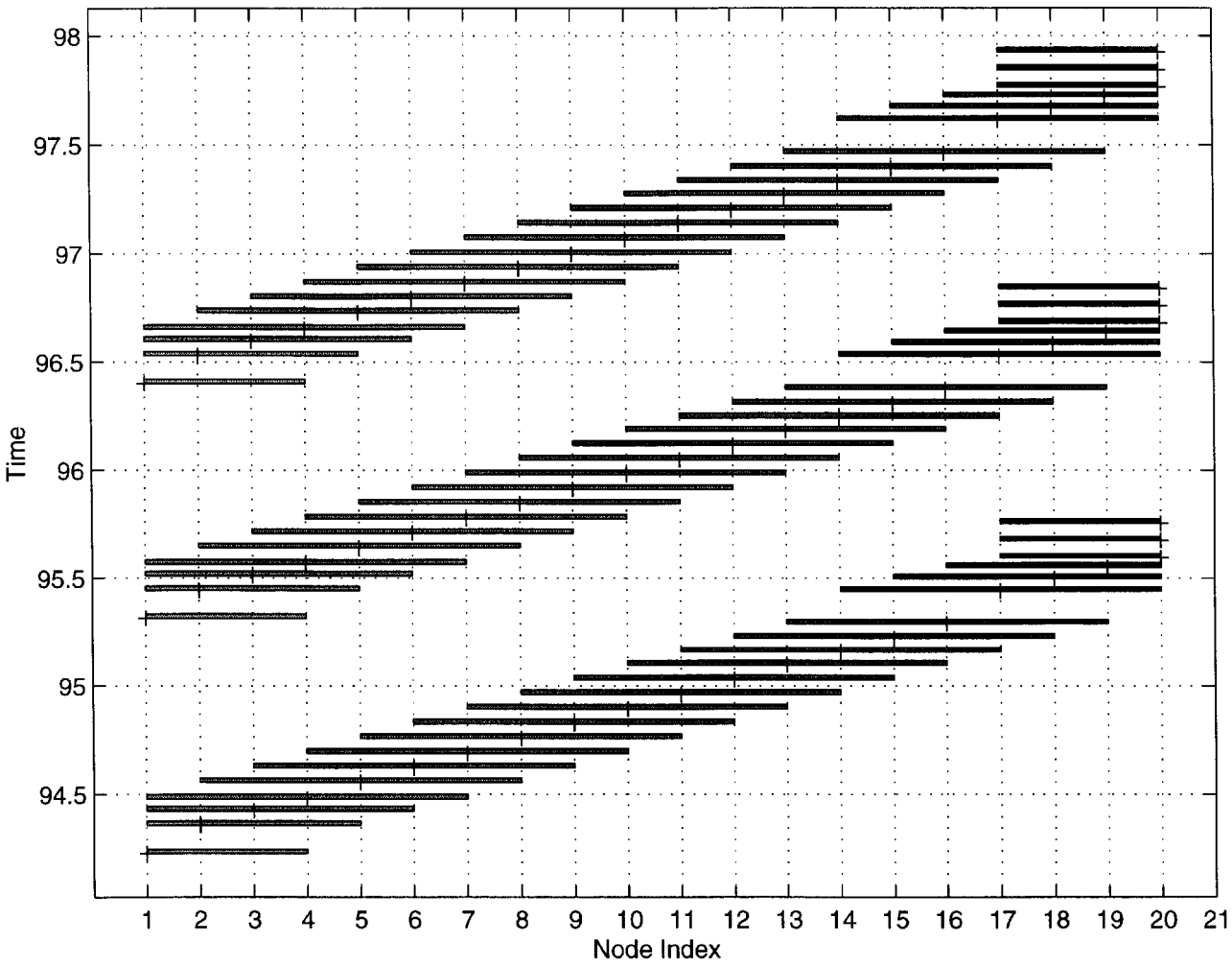
FIG. 6 is a graphic representation of a wave pattern with 3-nearest neighbor coupling.

In these simulations, the nodes follow the assumptions stated above. The nodes are initialized with random phases. Each node imitates an oscillator. When the oscillator of a node reaches the threshold, the node transmits. This transmission forms the coupling between nodes. FIGS. 5 and 6 show the firing sequence of the nodes once they have settled into a steady-state wave pattern for transmission epochs. These transmission epochs are both non-overlapping and sequential. This wave-pattern of transmission is utilized for networking, as described in more detail below. The time axis represents the time since the beginning of simulation. In FIG. 5, the total number of nodes is ten and the coupling is 1-nearest neighbor. The $10^{th}$ node transmits twice in each cycle as shown in FIG. 5. A wave-pattern can be observed in the transmission times of the nodes. In FIG. 6, the simulation results are provided for a total of twenty nodes with 3-nearest neighbor coupling. The end-node transmits three times in each cycle as shown in FIG. 6. FIG. 7 can be referred to for a full understanding of the meaning of the nodes and transmission epochs shown in FIG. 5 and 6.

Linking Process

Figure 8:
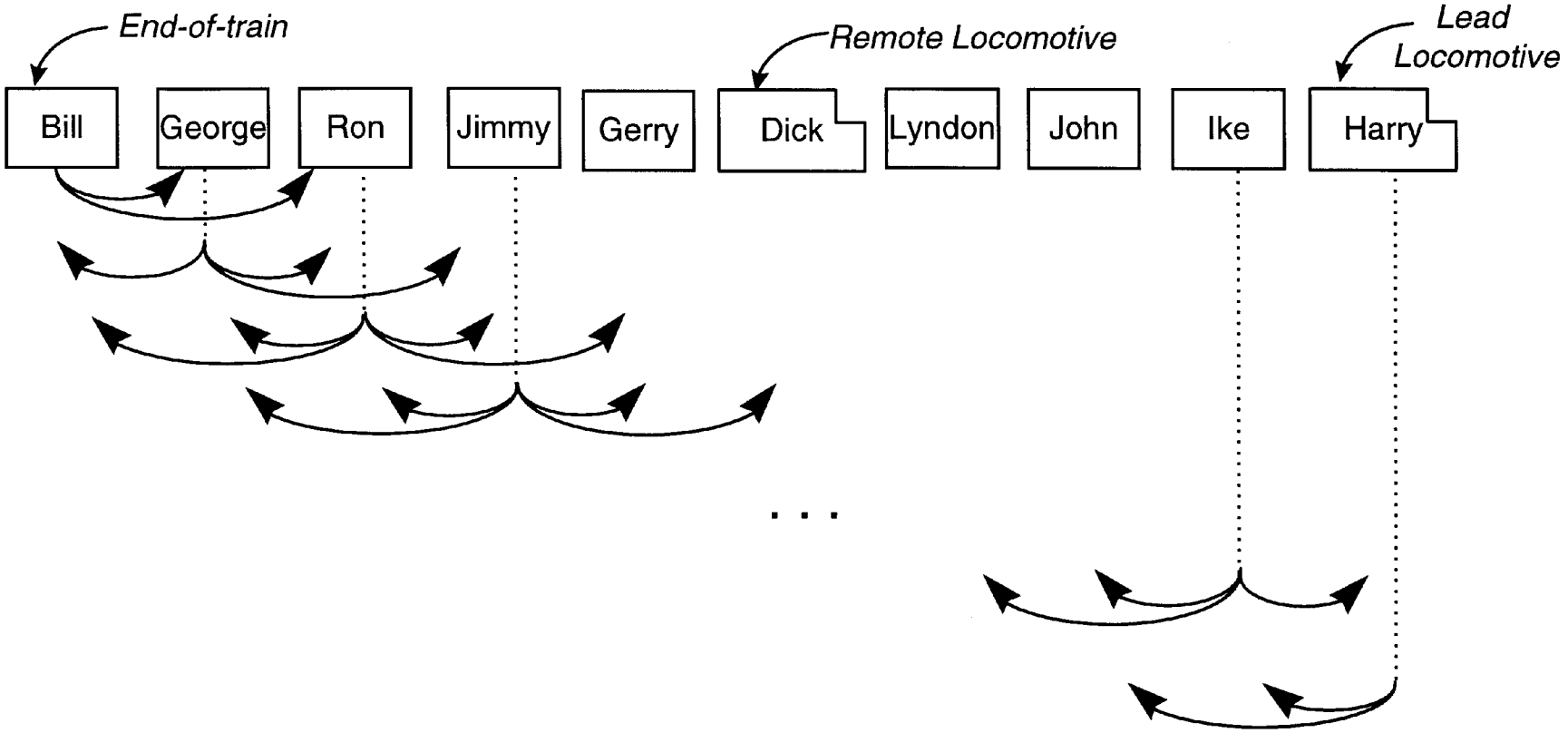
FIG. 8 is a block diagram showing an exemplary train with ten cars.

Having shown how a wave pattern of transmission can be set up by nodes imitating coupled oscillator behavior, it is important to show how this behavior gives rise to the features of the invention. This can be illustrated using a simple example of ten nodes positioned in a linear arrangement with 2-nearest neighbor coupling, as shown in FIG. 8. In this Figure, the unique ID names of the nodes have been replaced by human names in order to provide clarity. In this example, "Harry" is the ID of the lead locomotive or head-end unit (HEU) and "Bill" is the ID of the last car or end-of-train (EOT).

Figure 9:
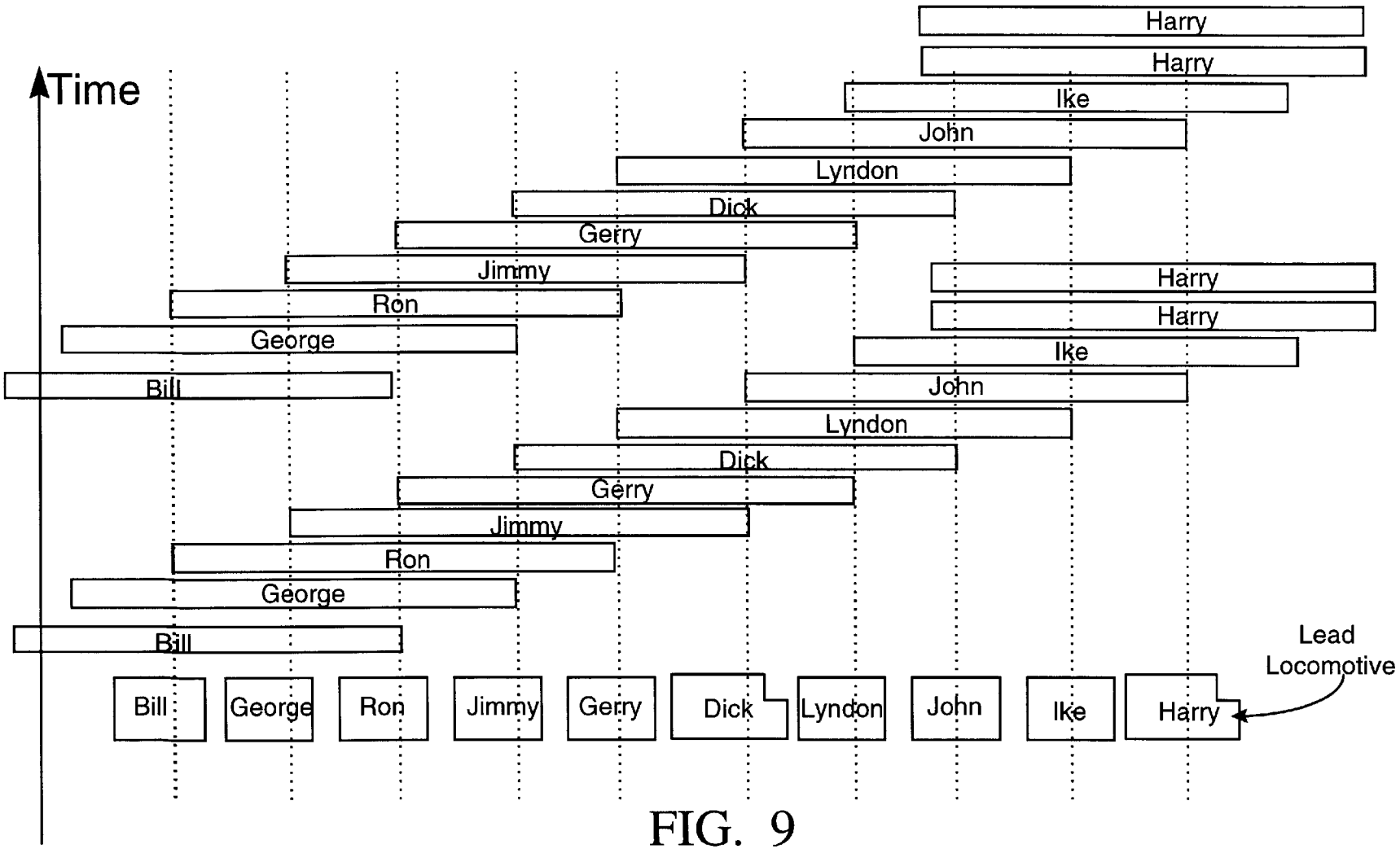
FIG. 9 is a graphic representation, based on the example of FIG. 8, of the wave pattern for packet transmission.

The imitation of coupled oscillators leads to the transmission behavior illustrated in FIG. 9. Setting up the pattern requires only recognition that a neighbor has transmitted and to transmit at an appropriately adjusted time. Content of the transmission does not matter. As in FIG. 6, for example, the transmission of each node is represented by a rectangular box centered at the transmitting node. The width of the box is the transmission time of the packet and its length represents the reception range of the packet. The transmission by each node contains the unique ID of the node.

Figure 10:
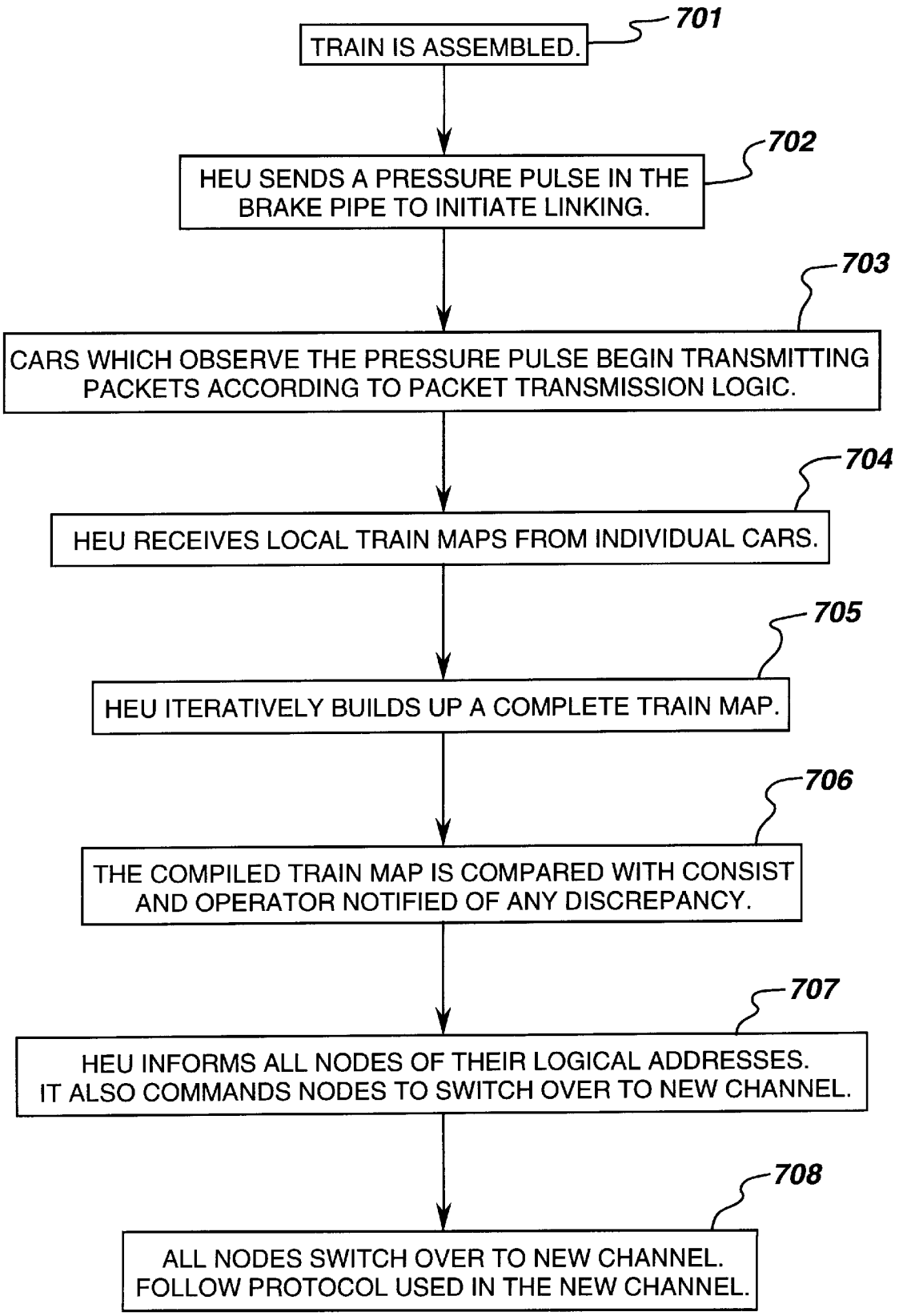
FIG. 10 is a flow chart of the train linking process according to the invention.

FIG. 10 provides an overview of the linking process for a train. The details of the process by which the HEU builds up a train map and then informs the local nodes about the train map are described, infra. The first step 701 in the linking process shown in FIG. 10 is to assemble the train, and at this time, the EOT is notified of its special status. At step 702, the HEU sends a pressure pulse in the brake pipe to initiate linking and, at step 703, cars which observe the pressure pulse begin transmitting packets. Each car transmits a "local network map" once every 20 cycles. Cars also follow logic for forwarding packets, which enables the local network maps to reach the HEU as indicated at step 704, and the HEU builds up a complete train map as indicated at step 705. At step 706, the compiled train map is compared with the consist and the operator is notified of any discrepancy. The HEU then informs all nodes of their logical addresses at step 707. At this time, the HEU also commands the nodes to switch over to a new channel. Finally, at step 708, all nodes switch over to a new channel and follow a predefined protocol in the new channel.

Figure 11:
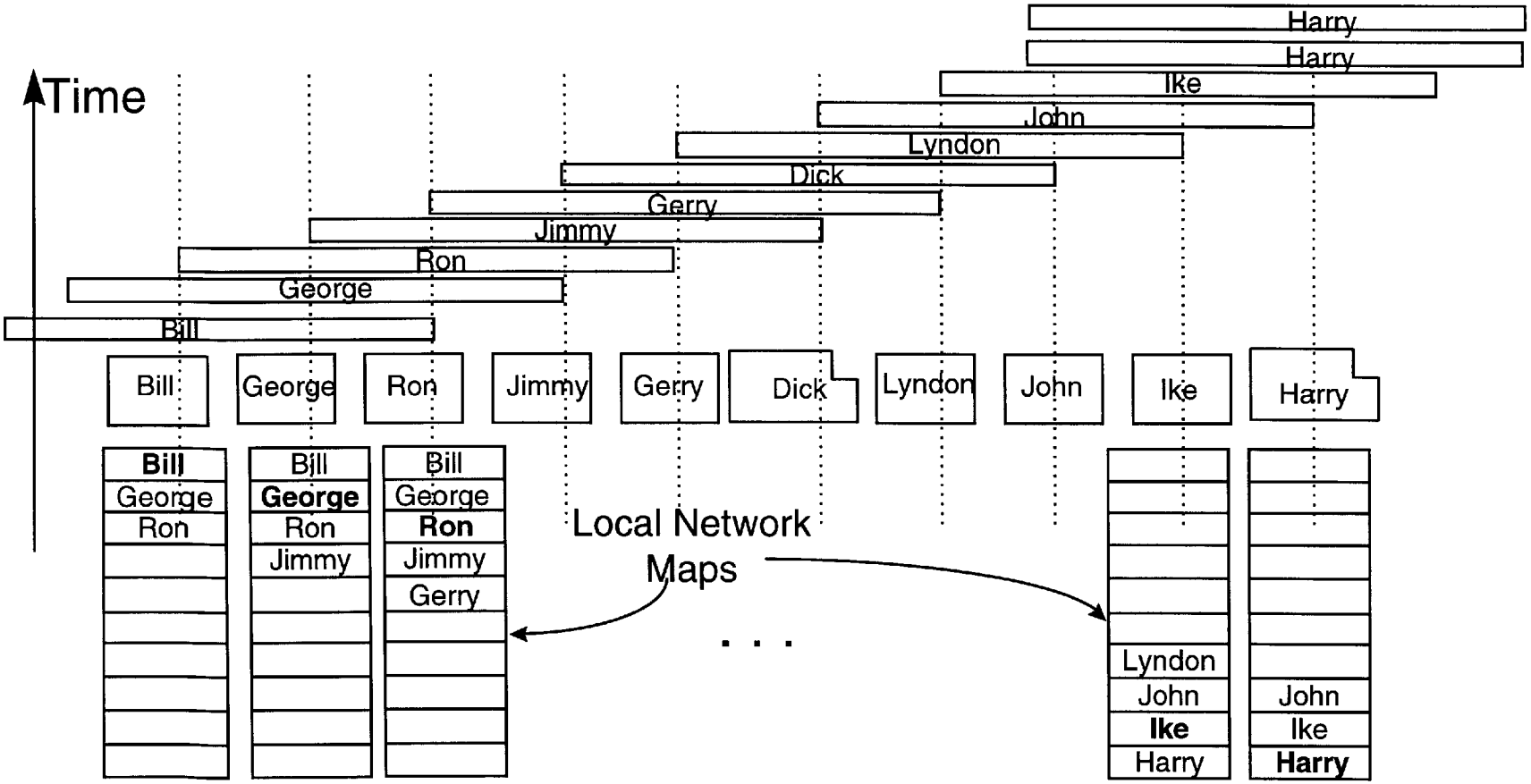
FIG. 11 is a graphic representation, based on the example of FIG. 8, of the wave pattern of transmission that enables each node to build a local network map.

In automatic network configuration, the HEU must know the sequence in which the nodes are placed in the train. This is referred to as "serialization". It has been shown, supra, how coupled oscillator model imitation leads to a wave pattern in transmissions from the nodes. When the oscillator "fires" at a node, the node transmits its unique ID. Due to the limited range of reception, each node then has a local map of the network, as indicated in FIG. 11. The local network map of any node relates the location of that node with respect to the nodes around it. This information is obtained through the sequence in which a node receives transmissions from other nodes. The local network map can be thought of as a piece of a jigsaw puzzle of the entire network map. Forwarding the local network map information to the HEU allows the HEU to build a map of the entire network. In the following description, the process of forwarding in both the directions is explained.

If the network configuration changes, i.e., one node moves with respect to another or additional nodes are added to the network, the transmission epochs of the nodes change to maintain the wave-pattern of transmission. The local network map changes at the pertinent nodes. The new local maps are relayed to the HEU and the network map is updated accordingly.

To make use of the orderly behavior in the context of a bi-directional network, the data to be transferred must include additional information. This can be assembled into a packet as shown below and as described in further detail in Table 1.

| bit-sync | pkt_sync | direct | xmt_addr | src_addr | seq_num | msg_type | msg | crc |
|---|---|---|---|---|---|---|---|---|

TABLE 1

| Field | Length | Purpose |
|---|---|---|
| bit-sync | Radio dependent | Receiver Synchronization |
| pkt_sync | Radio dependent | Determine packet boundary |
| direct | 2 bits | Direction in which packet should be forwarded (0 = none, 1 = up wave, 2 = down wave |
| xmt_addr | 4 bytes | Address of node currently transmitting packet |

TABLE 1-continued

| Field | Length | Purpose |
|---|---|---|
| src_addr | 4 bytes | Address of the source packet |
| seq_num | 1 byte | Along with the source address, uniquely identifies the packet. Increases by 1 modulo 256 for each new packet from source. |
| msg_type | 1 byte | Identifies type of message |
| msg | Variable (but short) | Information content of packet |
| crc | 2 bytes | Error Correcting Code. Extends over src_addr to msg fields. |

Figure 12:
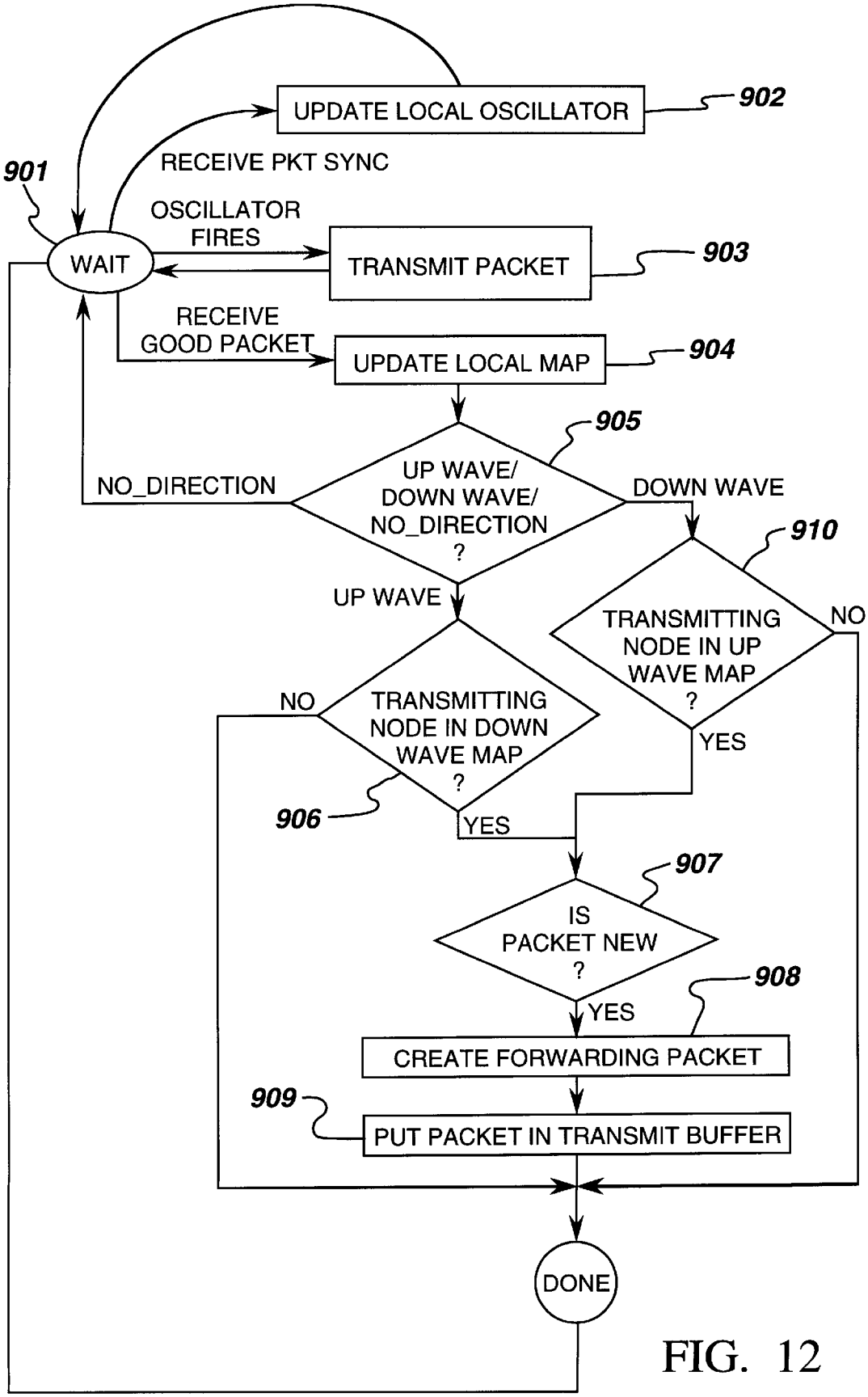
FIG. 12 is a flow chart showing the protocol logic at each node.

The logic of packet reception and forwarding at each node is shown in FIG. 12. The node is initially in a wait state 901. If a pkt_sync field is received, the local oscillator is updated at step 902, and the node returns to the wait state. If the oscillator fires (i.e., $\theta=1$), a packet is transmitted at step 903 and the node returns to the wait state. If a good packet is received, the node first updates its local map at step 904.

Figure 13:
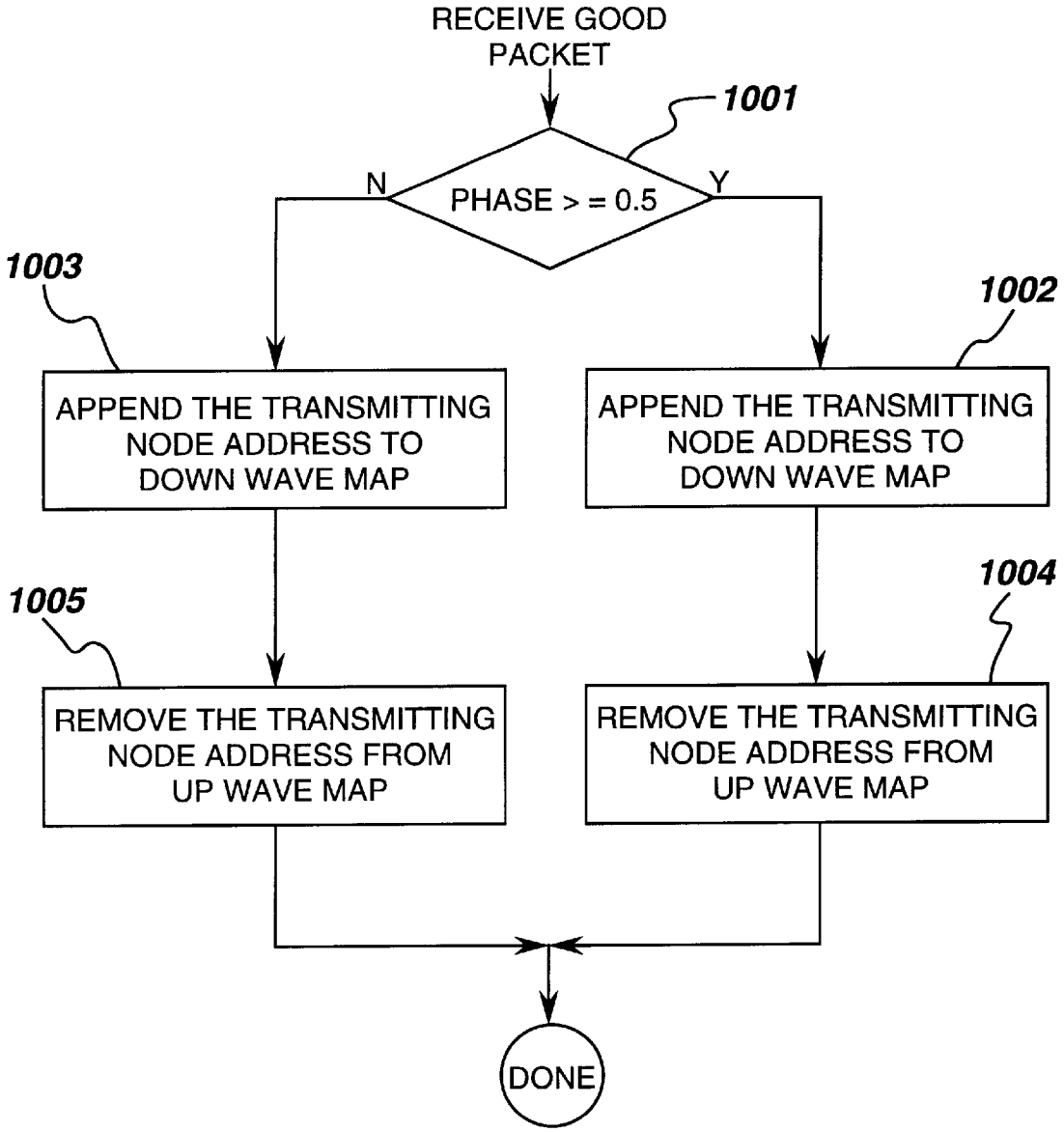
FIG. 13 is a flow chart for the logic of updating a local network map at each node.

The detailed logic of updating the local network map at each node is presented in FIG. 13. The logic for deciding whether the transmitting node of the received packet belongs to the up wave map or down wave map is based on the phase of the local oscillator. If the phase is greater than or equal to 0.5, as determined at step 1001, the node is appended to the up wave map as indicated at step 1002; otherwise, the node is appended to the down wave map as indicated at step 1003. When a node appends an address to one of the up wave and down wave maps, it ensures that the same node is not present in the other map. This is indicated at steps 1004 and 1005.

A determination is made at step 905 in FIG. 12 as to whether the received packet is to be forwarded. See the direct field in the packet as shown in Table 1 above. If the packet is not to be forwarded (i.e., 0=none), the node returns to the wait state. If the packet is to be forwarded up wave (i.e., 1=up wave), a determination is made at step 906 as to whether the transmitting node is in the down wave local map. If this is true and if the message is a new message, as determined at step 907, a new packet is generated at step 908. This new packet is placed in a transmit buffer at step 909, and the node returns to the wait state. If, on the other hand, the transmitting node is not in the down wave local map, nothing is done and the node returns to the wait state. If, at step 905, the packet is determined to be down wave (i.e., 2=down wave), then a determination is made at step 910 as to whether the transmitting node is in the up wave local map. If so, the process goes through steps 907, 908 and 909 before the node returns to the wait state; otherwise, nothing is done and the node returns to the wait state.

Figure 14:
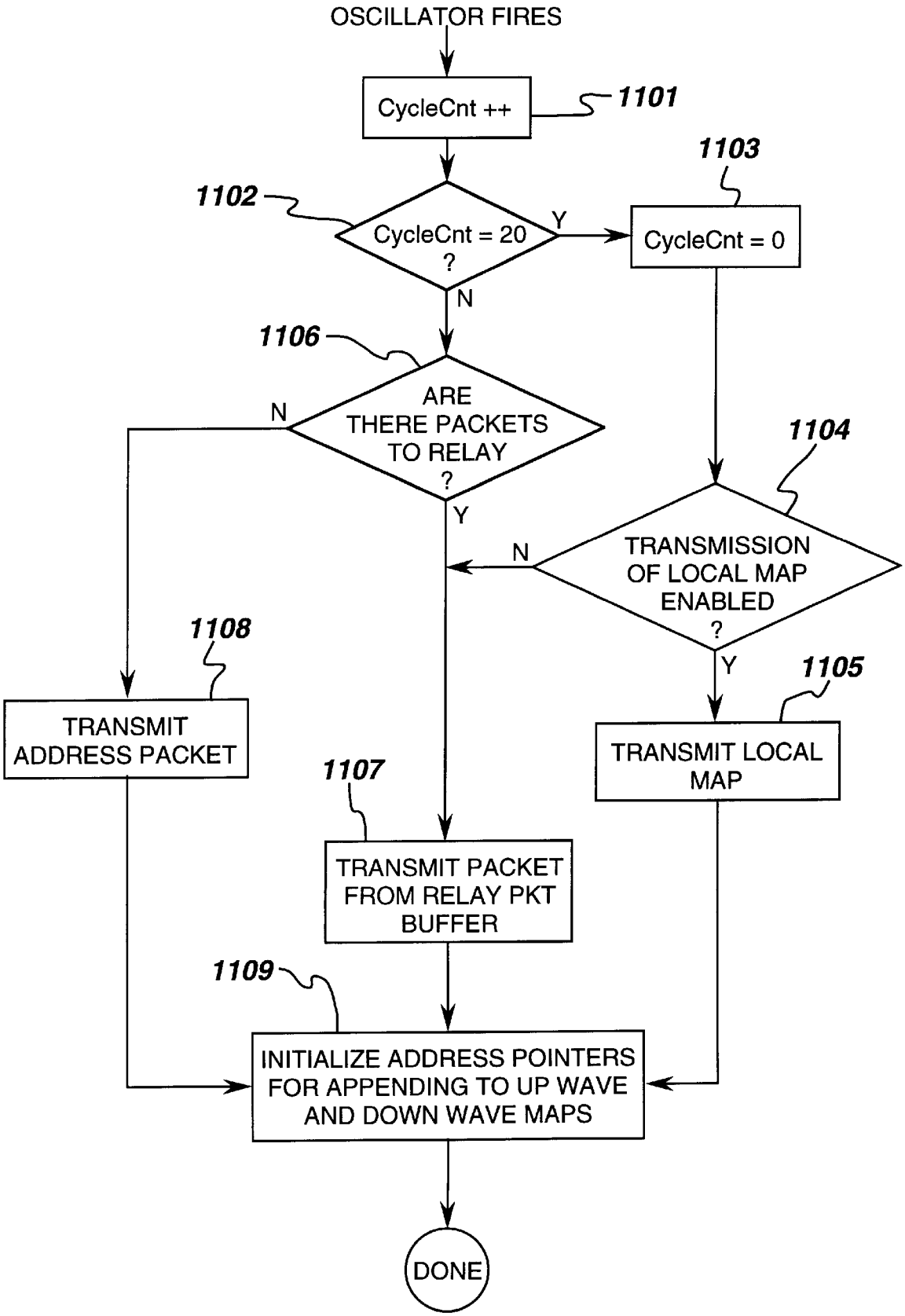
FIG. 14 is a flow chart for the logic of transmitting packets at each node.

The logic for transmission of packets at individual nodes is shown in FIG. 14. When the oscillator fires, the cycle counter is started at step 1101. Once every 20 cycles, as detected at step 1102, the cycle count is reset to zero at step 1103, and a test is made at step 1104 to determine if transmission of the local map has been enabled. If so, the node transmits its local map, as shown at step 1105. On all other cycles, a determination is made at step 1106 as to whether the node is to relay a packet at step 1107, for the case where the node has a packet in the relaying buffer, or is to transmit an address broadcast packet at step 1108, otherwise. At the end of packet transmission, the node resets the address pointers to append the node address to the up wave and down wave maps in function block 1109.

Figure 15:
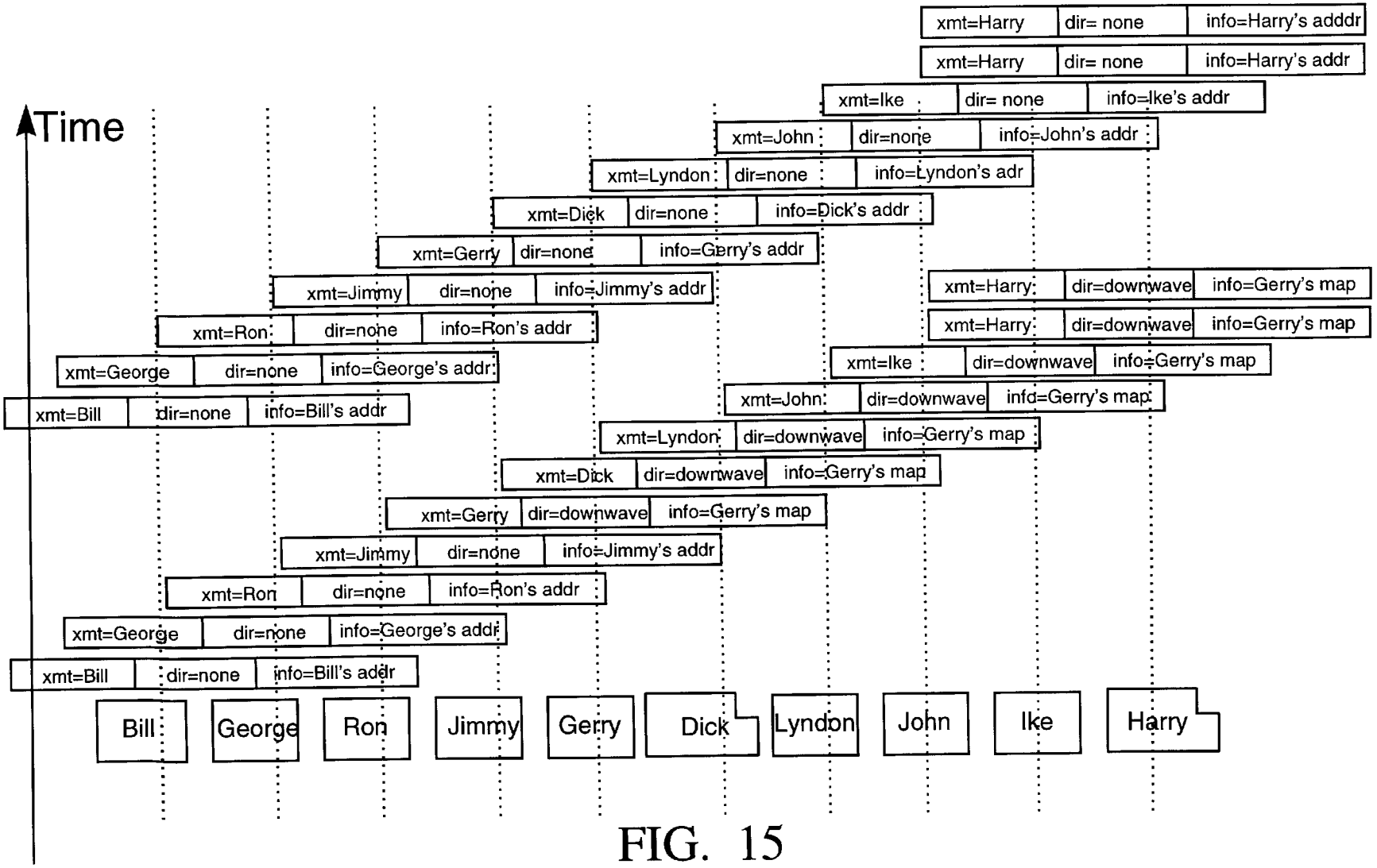
FIG. 15 is a graphic representation, based on the example of FIG. 8, of the case of forwarding an intermediate car's packet to the HEU.

An example of forwarding a packet in the down wave direction from "Gerry" is given in FIG. 15. All intermediate nodes between the originating node and the end-node repeat the packet in the down wave direction. In FIG. 15, for clarity, only the transmit address (xmt), direction (dir) and information (info) fields of the packets are shown. Hence the local map at each node enables it to forward a packet from any node in the network to the lead locomotive (HEU). In the ideal case, information from the last node (EOT) in the train is received at the lead locomotive in the time it takes a single wave to travel from the last node in the train to the lead locomotive.

The invention exhibits the robustness to packet errors provided by multiple node communication radius. For instance, in the above example, Gerry's information will be received at the lead locomotive even if Lyndon receives both Gerry's and Dick's transmissions in error, as long as John receives Dick's transmission without error and Harry receives either John's or Ike's transmission without error.

Figure 16:
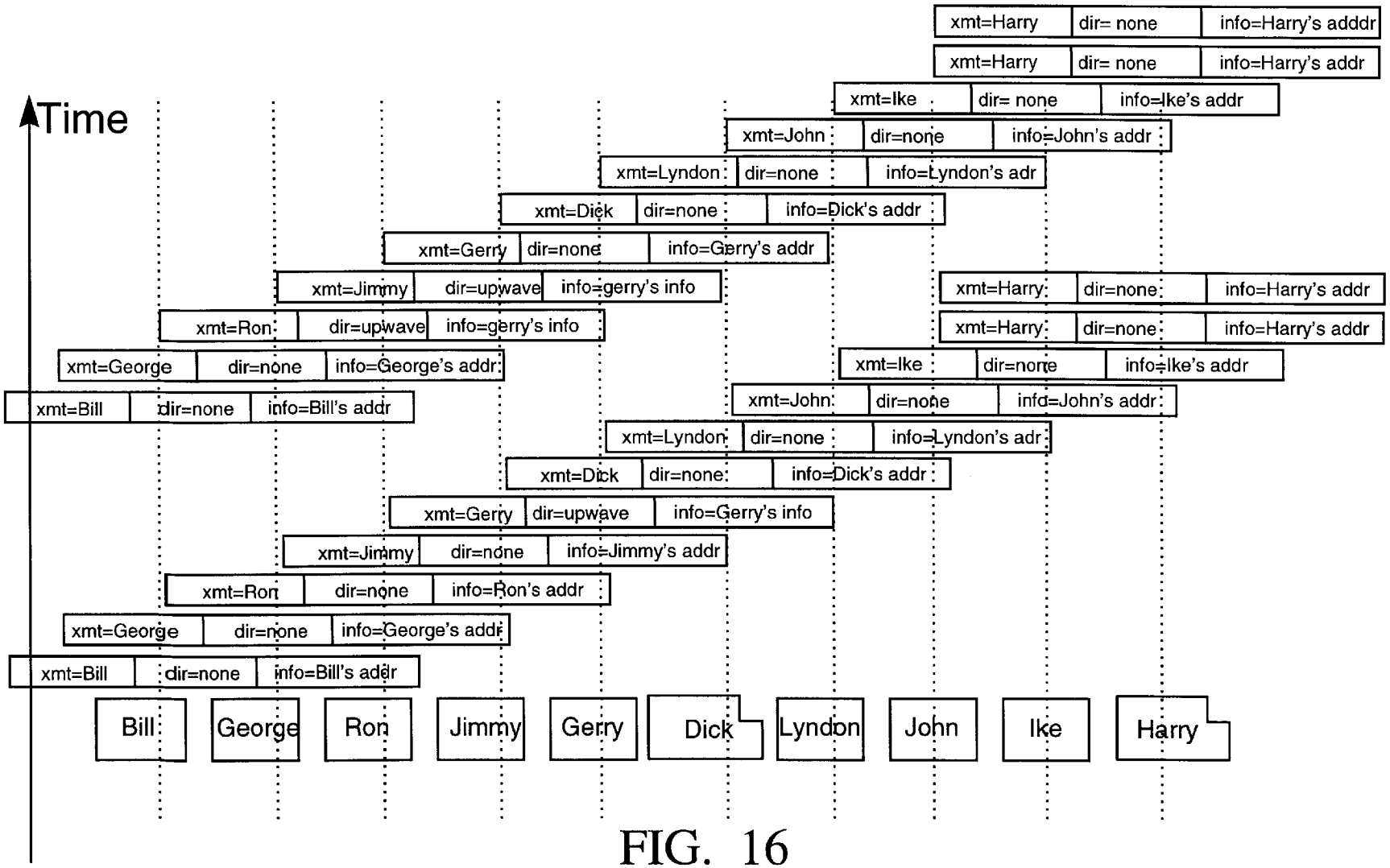
FIG. 16 is a graphic representation, based on the example of FIG. 8, of the case of forwarding an intermediate car's packet to the EOT.

The forwarding of packets in the up wave direction occurs similarly, and an example of this is shown in FIG. 16. However, multiple cycles are required for the packet to reach the EOT. In the example of FIG. 16, Gerry transmits a packet with direction field set to up wave direction in a cycle. This packet is received by Ron, Jimmy, Dick and Lyndon. Ron and Jimmy recognize that they need to forward the packet; however, they have already transmitted in the current cycle. So when the next cycle comes around, Ron and Jimmy both retransmit Gerry's packet. Both their transmissions are received by Bill, the intended receiver.

Figure 17:
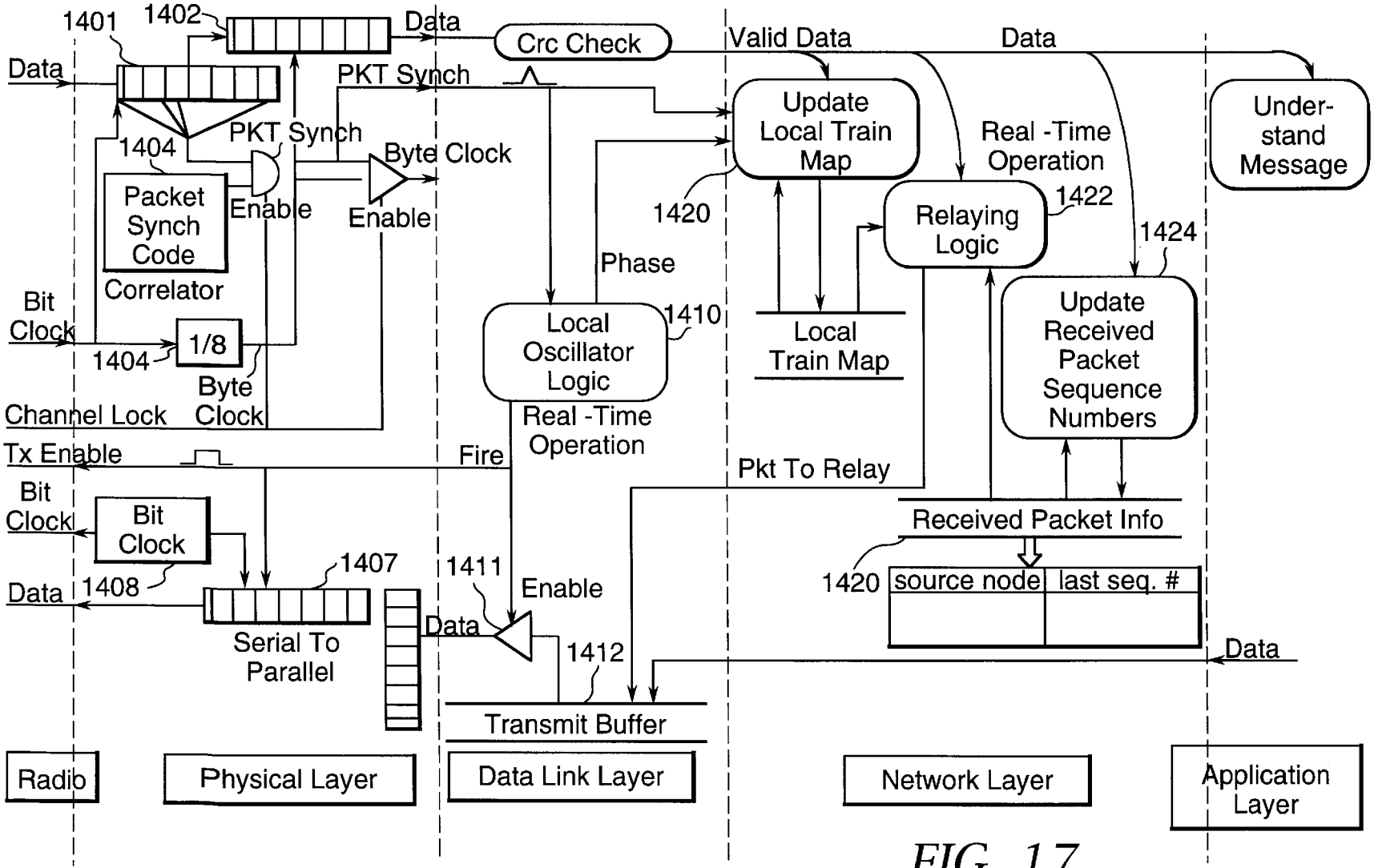
FIG. 17 is a block diagram of the hardware and software at each node of the train.

A hardware and software diagram of all the functions which need to be performed at each node for the linking protocol is shown in FIG. 17. This diagram is divided into several layers; a radio layer, a physical layer, a data link layer, a network layer, and an application layer. The radio layer is the interface which receives data, a bit clock and a channel lock, and transmits data, the bit clock and a transmit enable pulse. In the physical layer, the input data are clocked into a bit buffer 1401 by the bit clock, and each eight bits is supplied to a byte buffer 1402 by a byte clock derived from the bit clock by a three stage counter 1403. Data in bit buffer 1401 are compared with a packet synch code in a local store 1404 by a tri-state AND gate 1405 enabled by the channel lock. The detected packet synch is supplied by AND gate 1405 to the data link layer.

In the data link layer, the detected packet synch is supplied to local oscillator logic 1410 which determines when the oscillator "fires". "Firing" of the local oscillator enables a buffer 1411 for passing data from a transmit buffer 1412 to a buffer 1407 that converts the data format to serial form for transmission by the radio layer. Buffer 1407 is clocked by a bit clock 1408 and enabled by the transmit enable pulse from local oscillator logic 1410. In the data link layer, the data from byte buffer 1402 are checked by CRC check logic 1413 and passed to the network layer. Local oscillator logic 1410 also supplies phase information to the network layer.

In the network layer, a local train map 1421 is updated by logic 1420 enabled by the detected packet synch based on the valid data from CRC check logic 1413 and the phase data from local oscillator logic 1410. The valid data are also provided to relaying logic 1422, a received packet information buffer 1423, and the application layer. The data in received packet information buffer 1423 are updated by update logic 1424 according to received packet sequence numbers. Relaying logic 1422 formats updated local train map 1421 and the data in received packet information buffer 1423, and supplies them to transmit buffer 1412 in the data link layer. Transmit buffer 1412 also receives data from the application layer.

Figure 18:
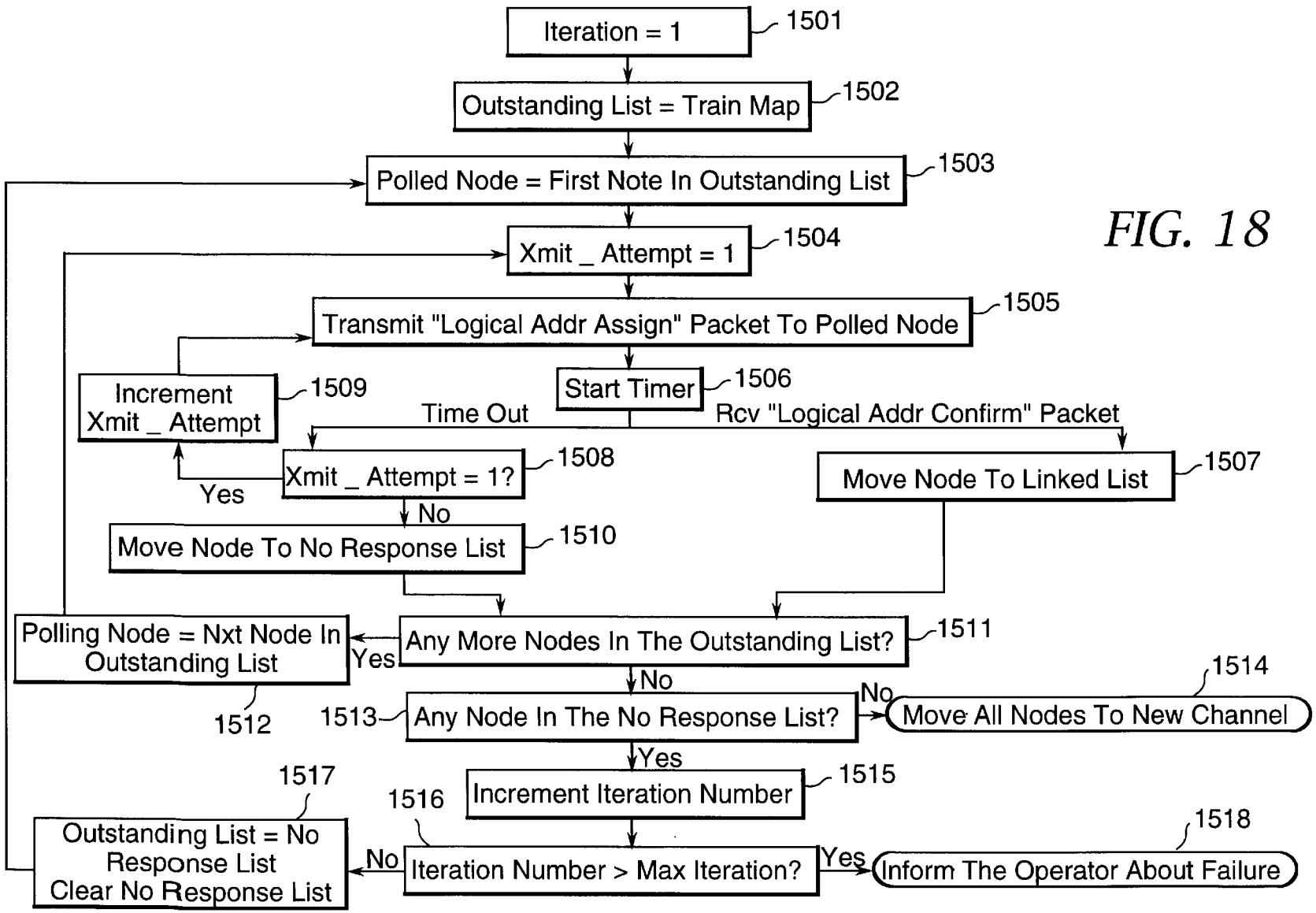
FIG. 18 is a flow chart of the logic at the HEU for informing cars about their logical addresses.
Figure 19:
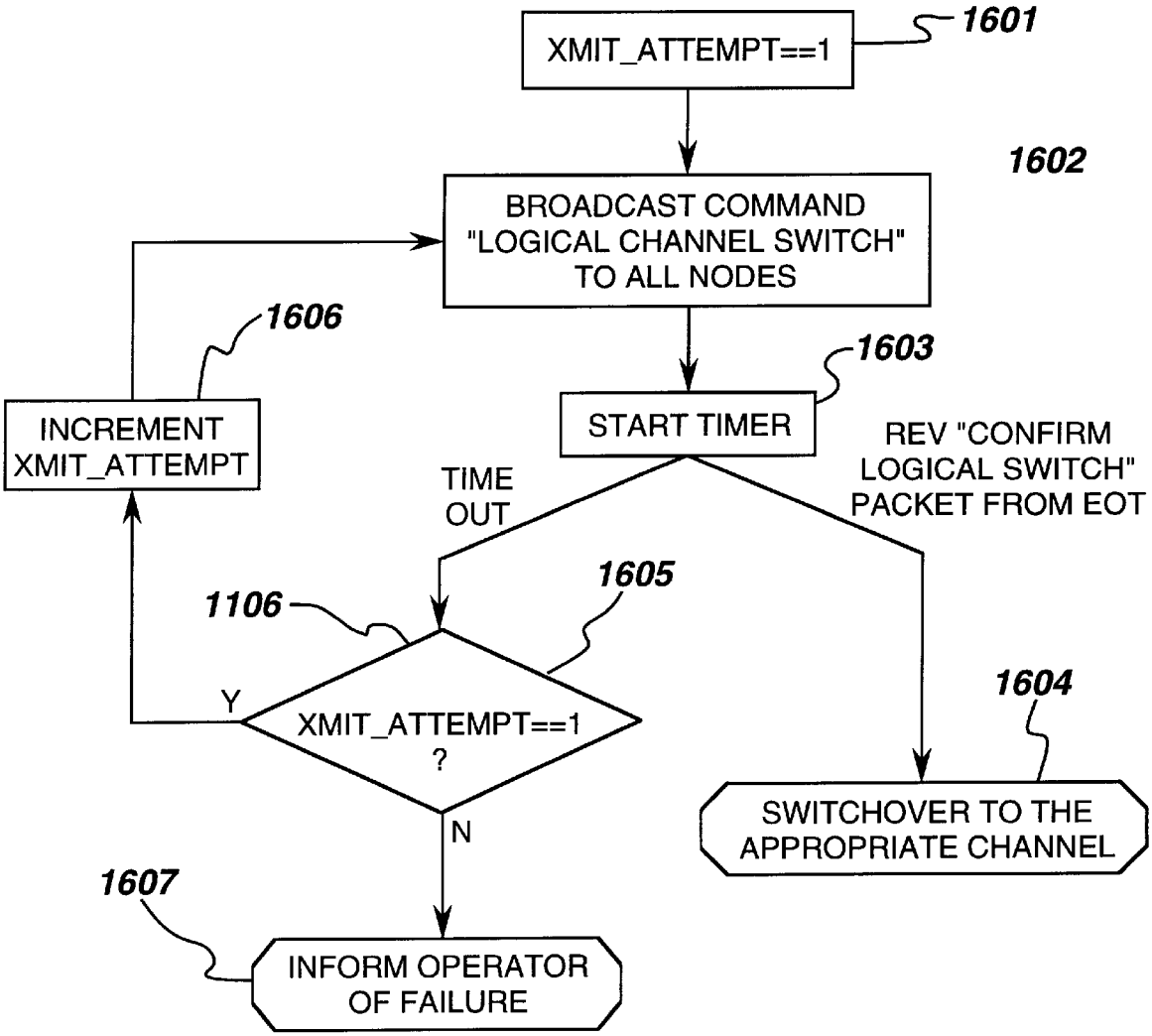
FIG. 19 is a flow chart of the logic at the HEU for switching over all the cars in the train to a new channel to be used by the protocol for the remainder of the trip.

FIGS. 18 and 19 are flow charts of the logic at the HEU to inform the cars about their logical addresses and then switch over to the normal protocol which is used for the remainder of the train trip, respectively. The process is initialized, as indicated in FIG. 18, by setting the iteration to 1 at step 1501 and setting the outstanding list to the train map at step 1502. The process then enters a nested set of loops, beginning with polling the first node in the outstanding list at step 1503. The transmit attempt number is set to 1 at step 1504, and then the HEU transmits a "Logical Addr Assign" packet to a polled node at step 1505. A local timer is started at step 1506 and, if a "Logical Addr Confirm" packet is received before the timer times out, the node is moved to the linked list at step 1507. If, on the other hand, the timer times out, a determination is made at step 1508 as to whether the transmit attempt number is 1. If so, the transmit attempt number is incremented at step 1509 before the process loops back to step 1505. If the transmit attempt number is not 1, as determined at step 1508, the node is moved to the no response list at step 1520.

The process moves from step 1507 or 1510 to decision step 1511 where a determination is made as to whether there are more nodes in the outstanding list. If so, the polling node is advanced to the next node in the outstanding list at step 1512, and the process loops back to step 1504; otherwise, a test is made at step 1513 to determine if there are any nodes in the no response list. If not, all nodes are moved to a new channel in output step 1514, which is shown in more detail in FIG. 16 and described below. If, however, there are nodes in the no response list, the iteration number is incremented at step 1515, and a test is made at decision step 1516 to determine if the incremented iteration number is greater than a preset maximum iteration. If the number is not greater than the preset maximum iteration, the outstanding list is set to the no response list at step 1517, and the process loops back to function step 1503. If the preset maximum iteration number is exceeded, however, then the operator is informed of the failure at output step 1518.

FIG. 19 illustrates the process of switching over all the cars in the train to a new channel. The process is initialized by setting the transmit attempt number to 1 at step 1601. The HEU then broadcasts a command "Logical Channel Switch" to all nodes at step 1602. A local timer is started at step 1603, and if a "Confirm Logic Switch" packet is received from the EOT before the local timer times out, the switchover to the appropriate channel is made at step 1604. If, however, the local timer times out, then a determination of whether the transmit attempt number is 1 is made at step 1605. If the transmit attempt number is 1, it is incremented at step 1606, and the process loops back to step 1602; otherwise, the operator is informed of the failure in output step 1607.

The wave pattern of transmissions of nodes shows that the times when a node receives packets from other nodes is close to the node's transmission time. For the remaining part of the cycle, there is no RF activity which affects the node. Hence, the node can be powered down, or placed in a sleep mode, for most of the cycle, and can switch on close to its own transmission time. The node "learns" the time it should turn on its RF unit by monitoring the RF activity over some cycles, once the wave pattern of transmission is set. Periodically or on exception basis, the node can switch on for some complete cycles to accommodate changes in the network configuration and hence transmission times of nodes.

Power consumption at each node can be further reduced by making the transmission by successive nodes closer to each other by changing the parameters of the phase-response curve. For instance, a small value of the phase shift $\theta_0$ could be used. Transmit power can also be reduced at any node by compressing the data received from other nodes before its retransmission.

While only certain preferred features of the invention have been illustrated and described, many modifications and changes will occur to those skilled in the art. It is, therefore, to be understood that the appended claims are intended to cover all such modifications and changes as fall within the true spirit of the invention.

Having thus described our invention, what we claim as new and desire to secure by Letters Patent is as follows:

1. A linking process for establishing a sequence of linked nodes at a head-node of an array of nodes, each of said nodes being equipped with a wireless communication device of limited range, the linking process comprising the steps of:

transmitting packets including a unique identification from each of said nodes, each said communication device modeling a phase-variable oscillator i such that when phase $\theta_i=1$, the $i^{th}$ oscillator "fires", transmitting the packet, and $\theta_i$ jumps back to zero and, on receiving a packet, changes phase according to a phase-response curve, thereby setting up a wave pattern of transmission of packets;

updating a local map at each node based on received packets from adjacent nodes;

periodically transmitting from each node a current local map; and compiling, at the head node, a network map of the sequence of the nodes in the network from the local maps received.

2. The linking process of claim 1 wherein the limited range of the wireless links is K-nearest-neighbors ($K \geqq 1$), and wherein $K>1$ provides robustness of communication in case one or more transmitters fails.

3. The linking process of claim 1 wherein the array of nodes comprises a linear array.

4. The linking process of claim 3 wherein the limited range of the wireless links is K-nearest-neighbors ($K \geqq 1$), and wherein $K>1$ provides robustness of communication in case one or more transmitters fails.

5. A linking process for establishing a sequence of cars in a train in which a locomotive is equipped with a head end unit (HEU) and each car in the train is equipped with a receiver and a transmitter as part of an electro-pneumatic braking system using wireless links of limited range to convey information up and down the train, the linking process comprising the steps of:

transmitting packets including a unique identification from each of said cars, each said transmitter modeling a phase-variable oscillator i such that when $\theta_i=1$, the $i^{th}$ oscillator "fires", transmitting the packet, and $\theta_i$ jumps back to zero and, on receiving a packet, changes phase according to a phase-response curve, thereby setting up a wave pattern of transmission of packets;

updating a local map at each car based on received packets from adjacent cars;

periodically transmitting from each car a current local map; and compiling, at the HEU, a train map of the sequence of the cars in the train from the local maps received.

6. The linking process of claim 5 wherein the limited range of the wireless links is K-nearest-neighbors ($K \geqq 1$), and wherein $K>1$ provides a robustness of communication in case one or more transmitters fails.

7. The linking process of claim 5 further comprising the step of initializing the linking process by the HEU.

8. The linking process of claim 7 wherein the step of initializing comprises sending from the HEU a pressure pulse in a train brake pipe to cars in the train, cars in the train which observe the pressure pulse transmitting packets.

9. The linking process of claim 5 further comprising the steps of comparing the compiled train map with consist information, and notifying an operator of any discrepancy between the train map and the consist information.

10. A method for determining the serial location of cars in a train equipped with wireless communication devices having a limited range allowing communication with its K-nearest-neighbors (K≧1), comprising the steps of:

modeling transmitters of the wireless communication devices as coupled oscillators, each of said oscillators being of variable phase θ which increases linearly from 0 to 1 such that, when θ=1, the oscillator "fires";

establishing a wave pattern of transmissions by the communication devices, each of said transmissions including a unique identification of the respective associated communication device; and building at each communication device on a respective one of said cars a local map of the respective car relative to K-nearest-neighbors of the respective car.

11. The method for determining the serial location of cars in a train recited in claim 10 further comprising the steps of:

designating a head end unit (HEU) in a lead locomotive of the train;

polling, by the HEU, each of the communication devices in the train to obtain a local map from each respective car; and constructing at the HEU a map of the train showing a serial location for each car in the train.

12. The method for determining the serial location of cars in a train recited in claim 11 wherein K>1 provides a robustness of communication in case one or more transmitters fails.

13. The method for determining the serial location of cars in a train recited in claim 10 further comprising the steps of:

comparing the map of the train with consist information of the train; and notifying an operator of any discrepancy between the consist information and the map of the train.

14. Apparatus for determining serial location of cars in a train, comprising:

wireless communication devices attached to each car in the train, the wireless communication devices having a limited range allowing communication with its K-nearest-neighbors (K≧1), transmitters of the wireless communication devices being modeled as coupled oscillators, each of said oscillators being of variable phase θ which increases linearly from 0 to 1 such that, when θ=1, the oscillator "fires"; and a head end unit (HEU) mounted in a lead locomotiveof said train and adapted to initialize a linking process, the wireless communication devices being adapted to respond to the initializing of the linking process by setting up a wave pattern of transmissions by the communication devices, each respective communication device being adapted to generate a local map of its K-nearest-neighbors, said HEU being adapted to thereafter poll the communication devices and construct a map of the train based on the local maps at each of the cars.

15. The apparatus for determining serial location of cars in a train recited in claim 14 wherein the train includes an electro-pneumatic braking system and the communication devices comprise radios that are part of the electro-pneumatic braking system.

16. The apparatus for determining serial location of cars in a train recited in claim 14 wherein K>1 precludes failure of one or more of the wireless communication devices from disrupting the constructing of the map.

17. A linking process for establishing a sequence of linked nodes at a head-node of an array of nodes, each of said nodes being equipped with a wireless communication device having a range that extends to less than all of the nodes of said array, the linking process comprising the steps of:

transmitting packets including a unique identification from each of said nodes, each said communication device modeling a phase-variable oscillator i such that when phase $\theta_i=1$, the $i^{th}$ oscillator "fires", transmitting the packet, and $\theta_i$ jumps back to zero and, on receiving a packet, changes phase according to a phase-response curve, thereby setting up a wave pattern of transmission of packets;

updating a local map at each node based on received packets from adjacent nodes;

periodically transmitting from each node a current local map; and compiling, at the head node, a network map of the sequence of the nodes in the network from the local maps received.

* * * * *